US006803017B2

(12) United States Patent
Bertolotti et al.

(10) Patent No.: US 6,803,017 B2
(45) Date of Patent: Oct. 12, 2004

(54) POWDER HOMOGENIZING APPARATUS, ITS USE, AND A HOMOGENIZING METHOD USING SAID APPARATUS

(75) Inventors: Gérard Bertolotti, Montreuil (FR); Christian Orange, Bricquebec (FR)

(73) Assignee: Compagnie Generale des Matieres Nuclearies, Velizy-Villacoublay (FR)

( * ) Notice: Subject to any disclaimer, the term of this patent is extended or adjusted under 35 U.S.C. 154(b) by 115 days.

(21) Appl. No.: 10/199,533

(22) Filed: Jul. 19, 2002

(65) Prior Publication Data

US 2003/0030194 A1 Feb. 13, 2003

(30) Foreign Application Priority Data

Jul. 20, 2001 (FR) ..... 01 09709

(51) Int. Cl.[7] ..... B01F 7/10
(52) U.S. Cl. ..... 266/213; 366/114; 366/316
(58) Field of Search ..... 266/213; 432/103; 378/44–50; 366/114, 286, 316, 317

(56) References Cited

U.S. PATENT DOCUMENTS 3,672,642 A 6/1972 Beisswenger ..... 259/50
6,253,629 B1 * 7/2001 Lee et al. ..... 73/864.45
6,450,680 B1 * 9/2002 Bertolotti et al. ..... 366/114

FOREIGN PATENT DOCUMENTS

| | | |
|---|---|---|
| FR | 2094283 | 1/1972 |
| FR | 2792544 | 10/2000 |
| JP | 55031476 | 3/1980 |
| JP | 09 2395253 | 9/1997 |
| JP | 11109088 | 4/1999 |
| JP | 11109089 | 4/1999 |

* cited by examiner

*Primary Examiner*—Scott Kastler
(74) *Attorney, Agent, or Firm*—Cohen, Pontani, Lieberman & Pavane

(57) ABSTRACT

The powder homogenizing apparatus of the invention comprises a cylindrical shell with a circular section and a substantially horizontal axis, an assembly of cylindrical drums disposed inside the shell and comprising an inner drum and an outer drum, the external face of the cylindrical wall of said outer drum being overlaid with blades, which drum assembly can homogenize the powder contained in the annular space formed between the outer drum and the shell, a space of revolution being formed between said inner and outer drums, and a shaft on which said cylindrical drum assembly is mounted in integral manner, said shaft being hollow and connected outside the shell to a cold air supply system and also connected to an air exhaust system outside the shell; drive means for rotating said shaft are also provided.

21 Claims, 4 Drawing Sheets

POWDER HOMOGENIZING APPARATUS, ITS USE, AND A HOMOGENIZING METHOD USING SAID APPARATUS

FIELD OF THE INVENTION

The present invention relates to powder homogenizing apparatus, to its use and to a homogenizing method using said apparatus.

More specifically, but not exclusively, the present invention relates to a powder homogenizing apparatus that is specially adapted to a heat-releasing noxious powder, in particular a radioactive powder such as plutonium oxide, more particularly plutonium dioxide ($PuO_2$).

Such a homogenizing apparatus must simultaneously satisfy requirements as to homogeneity, grain size and isotopic composition of the powder, and avoid segregation, while also removing the heat released from the noxious powder per se and produced by agitating it.

A further aim of the present invention is to provide a homogenizing apparatus for a noxious powder that can be integrated into a treatment line between upstream and downstream apparatus, which can also evacuate the powder towards downstream apparatus while monitoring and regulating the flow rate of the powder from the homogenizing apparatus to the downstream apparatus.

BACKGROUND OF THE INVENTION

Powder homogenizing apparatuses that have been proposed up to the present time cannot effectively satisfy all of those conditions.

OBJECTS AND SUMMARY OF THE INVENTION

The present invention satisfies those conditions by providing powder homogenizing apparatus comprising:

a cylindrical shell of circular section and of substantially horizontal axis, which shell is sealed and with a cylindrical barrel closed at its ends by two disk-shaped end plates, said shell being provided with at least one filler orifice located in the upper portion of said shell and at least one discharge orifice opening into the bottom of said shell;

an assembly of cylindrical drums of circular section located inside the shell with which it is coaxial and fluidtight, said drum assembly comprising an inner drum and an outer drum each provided with a cylindrical wall closed at its ends by two disk-shaped walls, the external face of the cylindrical wall of said outer drum being overlaid with blades capable of homogenizing the powder contained in the annular space formed between the cylindrical wall of the outer drum and the barrel of the shell, a space of revolution being formed between said inner and outer drums;

a shaft disposed along said longitudinal axis through said cylindrical shell, mounted on a bearing at each end plate and on which said assembly of cylindrical drums is mounted in integral manner, said shaft comprising a first end portion provided with a first internal longitudinal channel and a second end portion provided with a second internal longitudinal channel, said first channel being connected, outside the shell, to a system for supplying cold air and said first end portion being provided inside said shell with at least one supply orifice for providing cold air to said space of revolution from said first channel, said second end portion being provided, inside said shell, with at least one exhaust orifice placing said space of revolution in fluid communication with said second channel, and said second channel being connected, outside said shell, to an air exhaust system to release air from said space of revolution, a sealing system being provided for each bearing; and drive means for rotating said shaft.

It should be understood that this solution uses an internal system for cooling the homogenizing apparatus and the powder it contains. It should also be understood that this solution enables homogenization to be carried out by mixing powder contained in the annular space formed between the cylindrical wall of the outer movable drum and the barrel of the fixed shell. The powder can be cooled by the presence of cold air inside the space of revolution defined between the outer drum and the inner drum, which results in a large heat exchange surface (the whole surface of the cylindrical wall of the outer drum) between the cold air and the powder.

The expression "axial half" of the inner drum or the outer drum as used below will be used to mean one of the two portions (or first longitudinal half drum) of this drum separated from the other portion (or second longitudinal half drum) by a transverse plane that is orthogonal to the longitudinal or axial direction (X, X') of the drum, said transverse plane being located half way along the drum concerned. In FIGS. 1 and 2, this transverse plane is that containing axes (Y, Y') and (Z, Z').

Preferably, said blades are helical and form a screw pitch that is reversed with respect to the pitch of the other axial half of the outer drum.

Preferably again, the outer face of the cylindrical wall of each axial half of the outer drum is overlaid with an inner helical blade attached to said outer surface all the way along said axial half and with an outer helical blade spaced from said outer face along the entire length of said axial half, said inner and outer blades being of screw pitch that is reversed with respect to the pitch on the other axial half of the cylindrical wall.

To further improve heat exchange inside the homogenizing apparatus, the space defined between the outer drum and the inner drum is preferably provided with fins.

To improve the powder-cooling performance of the homogenizing apparatus, in a highly advantageous solution, at least the lower portion of said barrel is formed from a double-walled sealed jacket in which cold air from a cold air supply system can circulate.

Clearly, that disposition adds an external cooling system located outside the annular space containing the powder to the internal cooling system.

To improve the heat exchange capacities of said external cooling system, the face of the upper wall of said jacket facing the interior of said jacket is provided with fins.

The present invention also provides the use of a powder homogenizing apparatus of the type defined above, the apparatus being placed in a glovebox, said powder being radioactive and preferably constituted by plutonium dioxide ($PuO_2$).

The present invention also provides a method of homogenizing and cooling a powder, using a powder homogenizing apparatus of the type defined above, the method comprising the following steps:

a) closing the discharge orifice;

b) activating said drive means to cause said shaft and said drum assembly to rotate;

c) activating said system for supplying cold air to fill and circulate cold air in the space defined between the outer drum and the inner drum;

d) opening said filler orifice to allow powder to enter said annular space between the outer drum and the barrel of the shell;

e) closing said filler orifice when the desired quantity of powder has been introduced into said annular space;

f) carrying out homogenization by rotating said shaft and said drum assembly; and g) opening said discharge orifice to empty said annular space when homogenization is complete.

BRIEF DESCRIPTION OF THE DRAWINGS

Other characteristics and advantages of the present invention become apparent from the following description of an embodiment made with reference to the accompanying drawings, given simply by way of non-limiting example, in which.

MORE DETAILED DESCRIPTION

Figure 1:
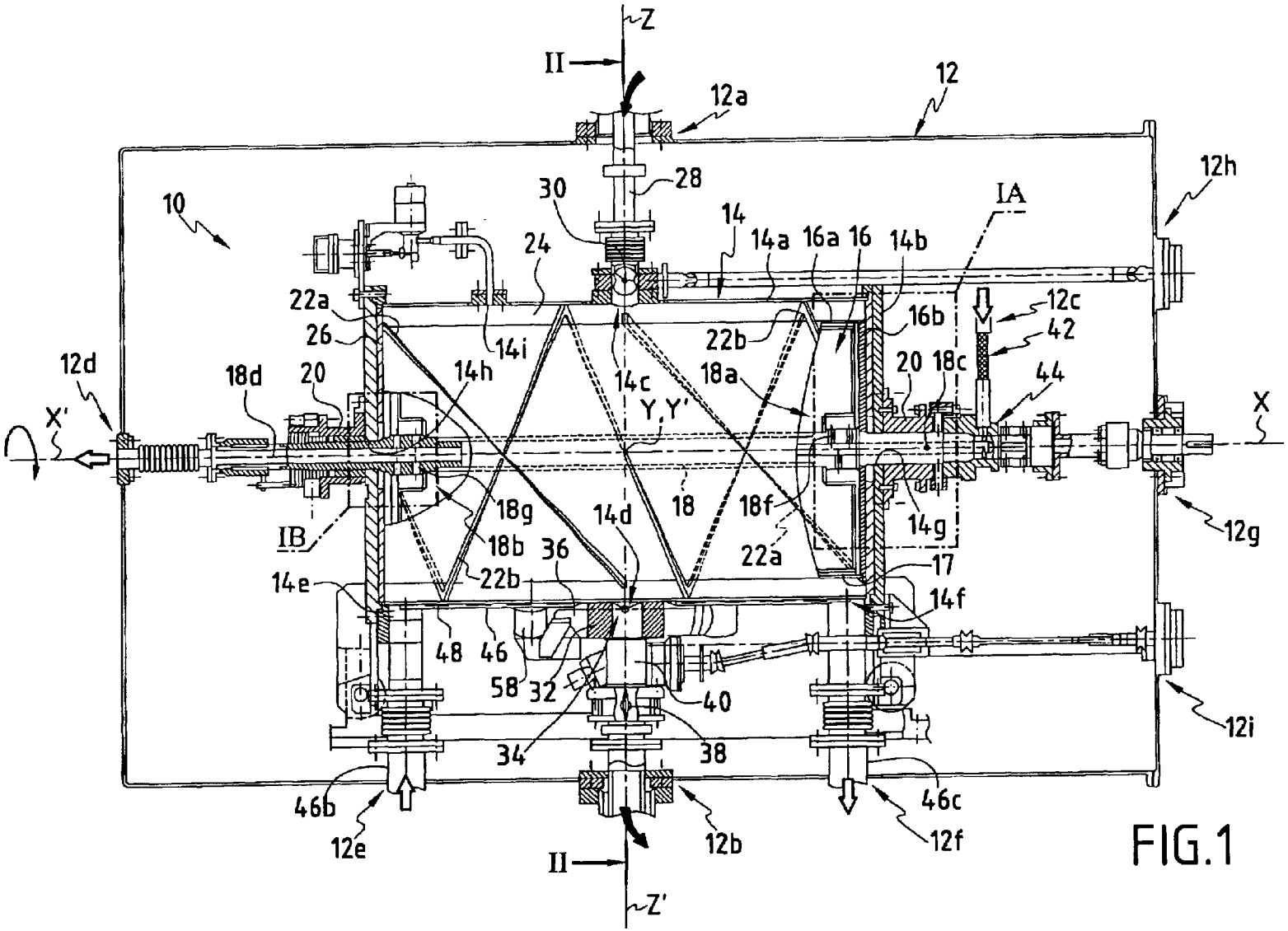
FIG. 1 is a longitudinal section on direction I—I in FIG. 2 through the powder homogenizing apparatus of the present invention.
Figure 3:
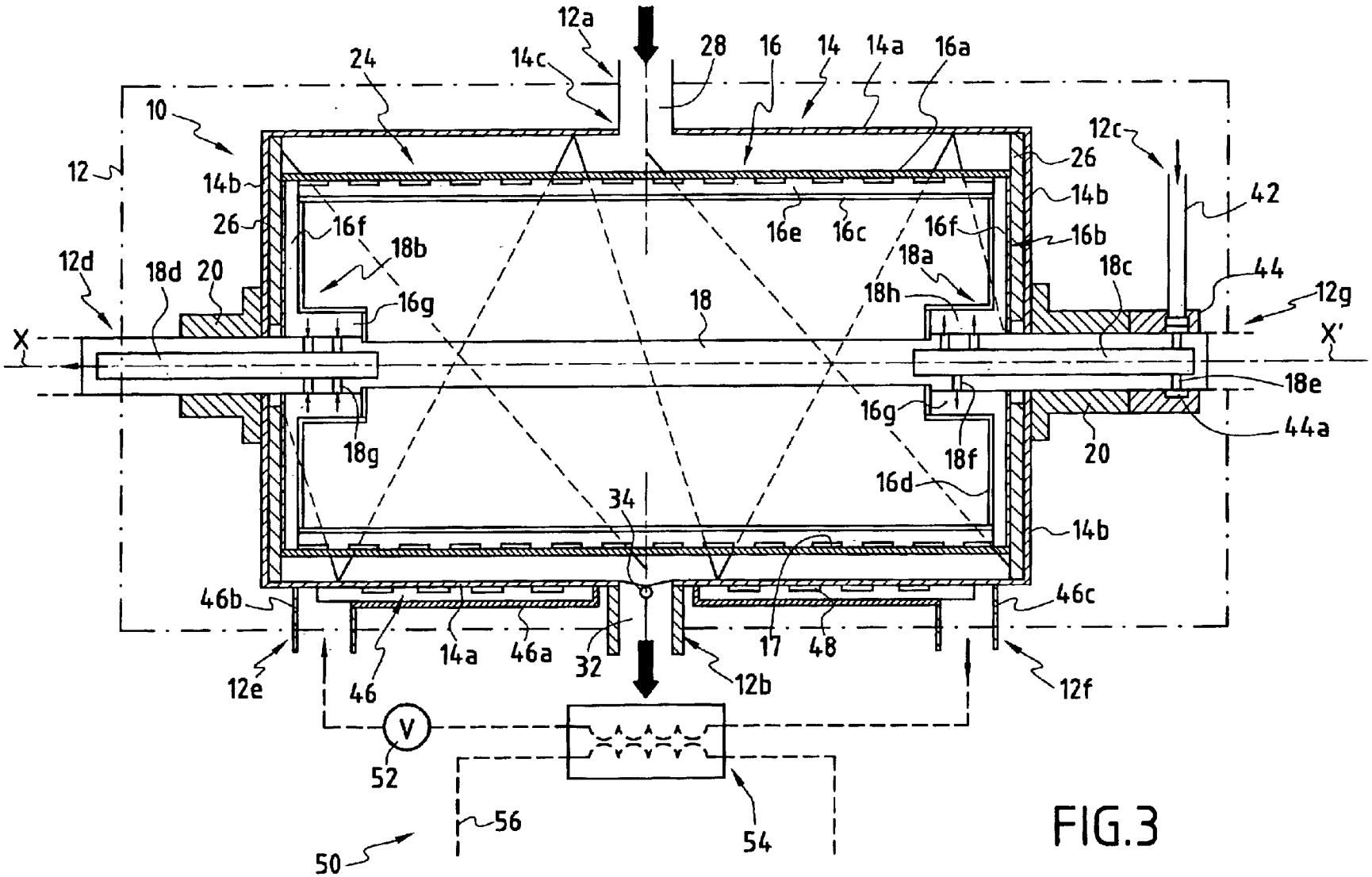
FIG. 3 is a longitudinal section schematically showing the cooling technique used in the powder homogenizing apparatus of the present invention.

As shown in FIGS. 1 and 3, the homogenizing apparatus 10 of the present invention is disposed in a glovebox 12 forming a chamber that perfectly isolates the apparatus from its environment. This glovebox 12, however, has the following openings:

an opening 12*a*, placed in the upper portion of the glovebox 12, to connect the homogenizing apparatus 10 to an upstream apparatus;

an opening 12*b*, disposed in the lower portion of the glovebox 12 to connect the homogenizing apparatus 10 to a downstream apparatus;

an opening 12*c* and an opening 12*d* for connecting the inlet and outlet respectively of the internal cooling system to an air supply line and to an air exhaust line;

openings 12*e* and 12*f* located in the lower portion of the glovebox at each of the ends in the longitudinal direction of the homogenizing apparatus 10, as air inlet and outlet respectively for the external cooling system;

an opening 12*g*, for the passage of a system for mechanical connection between a rotary shaft and drive means; and openings 12*h* and 12*i*, for the passage of means for controlling the various valves respectively controlling the powder inlet and outlet.

The powder homogenizing apparatus 10 essentially comprises a cylindrical shell 14 comprising a set 16 of rotary cylindrical drums and a shaft 18 disposed in the longitudinal axial direction (XX') of the shell 14 and the drum assembly 16.

The shell 14 is composed of a cylindrical barrel 14*a* defining a cylindrical volume of circular section that is sealed by two disk-shaped end plates 14*b* disposed at the two ends of the barrel 14*a*.

The drum assembly 16 is mounted coaxially inside the shell 14 about the shaft 18 to which it is secured. The shaft 18 passes through the shell 14 longitudinally and is rotatably mounted with respect to this shell 14 by two bearings 20 respectively mounted at the front and rear of the shell 14 on the outer face of the end plates 14*b* (see FIGS. 1A and 1B).

The drum assembly 16 disposed inside the shell 14 is composed of an outer drum and an inner drum that are mutually coaxial about axis (X, X') and that are secured to the shaft 18.

The outer drum is composed of a cylindrical wall 16*a* of smaller diameter than the barrel 14*a*, and of two disk-shaped walls 16*b*, where the cylindrical wall 16*a* is substantially shorter than the barrel 14*a* along the axis (X, X').

The inner drum disposed inside the outer drum is composed of a cylindrical wall 16*c* of smaller diameter than the cylindrical wall 16*a* of the external wall, and of two disk-shaped walls 16*d*, where the cylindrical wall 16*c* is shorter than the cylindrical wall 16*a* along the axis (X, X').

A space of revolution about the axis (X, X') is formed between the outer drum and the inner drum to allow the powder to be cooled, as is explained below. This space of revolution comprises a longitudinal zone 16*e* located between the cylindrical wall 16*a* of the outer drum and the cylindrical wall 16*c* of the inner drum, and two radial zones 16*f* located between one of the disk-shaped walls 16*b* of the outer drum and the corresponding disk-shaped wall 16*d* of the inner drum. Each radial zone 16*f* is in the form of a disk surrounding the shaft 18, this radial zone 16*f* being thicker close to the shaft to define an enlarged zone 16*g*.

The external face of the cylindrical wall 16*a* of the outer drum is overlaid with helical blades 22*a*, 22*b* for stirring and mixing the powder contained in an annular space 24 defined between this cylindrical wall 16*a* and the barrel 14*a* to homogenize said powder.

Each axial half of the cylindrical wall 16*a* of the outer drum (to the right and left of the direction II—II in FIG. 1) is provided with a helical inner blade 22*a* extending integrally over 180°, being adjacent along its entire length to the external face of the axial half of the cylindrical wall 16*a* of the outer drum.

As can be seen in FIG. 1, the right axial half of the cylindrical wall 16*a* of the outer drum is provided with a first inner helical blade 22*a* forming a screw thread that turns to the left, while the left axial half of the cylindrical wall 16*a* of the outer drum is provided with a second inner helical blade 22*a* forming a screw thread that turns to the right. The first inner blade 22*a* and the second inner blade 22*a* are positioned diametrically opposite each other (respectively to the rear of and in front of the drum assembly 16 in FIG. 1) and on different longitudinal or axial halves of the external face of the cylindrical wall 16*a* of the outer drum (respectively to the right and left of the plane passing through axes (Y, Y') and (Z, Z') in FIG. 1). Each of the two inner blades 22*a* extends over its entire length and over half of the circumference of one axial half of the cylindrical wall 16*a* of the outer drum.

Each axial half of the cylindrical wall 16*a* of the outer drum (to the right and left of the direction II—II in FIG. 1) is also provided with an outer helical blade 22*b* extending integrally over 360° over the entire length of the external face of the axial half of the cylindrical wall 16*a* of the outer drum. Said outer blades 22*b* are spaced from the external face of the outer drum to create a passage to allow powder to pass between them and the cylindrical wall 16*a*. The outer blades, 22*b* are substantially tangential to the barrel 14*a* to scrape the face of the inward facing wall of the barrel 14*a*.

As can be seen in FIG. 1, the right axial half of the cylindrical wall 16*a* of the outer drum is provided with a first outer helical blade 22*b* forming a screw thread turning to the right, while the left axial half of the cylindrical wall 16*a* of the outer drum is provided with a second outer helical blade 22*b* forming a screw thread that turns to the left. The first outer blade 22*b* and the second outer blade 22*b* are located on different longitudinal or axial halves of the external face of the cylindrical wall 16*a* of the outer drum (respectively to the right and left of the plane passing through axes (Y, Y') and (Z, Z') in FIG. 1) by being disposed symmetrically with respect to each other about the point of intersection of axes (Y, Y') and (Z, Z'). Each of the two outer blades 22*b* extends over the entire length and the entire circumference of one axial half of the cylindrical wall 16*a* of the outer drum.

Figure 2:
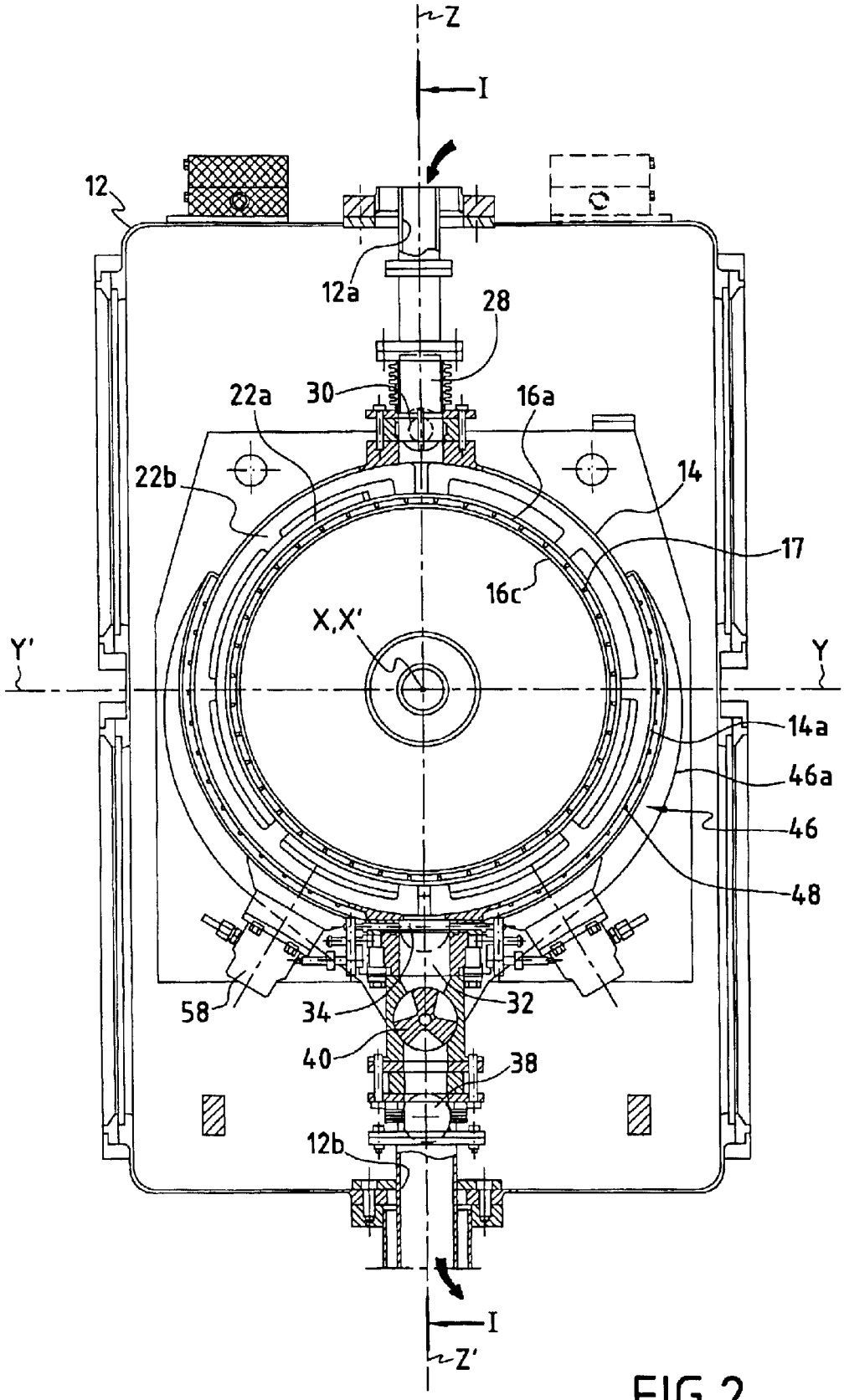
FIG. 2 is a cross section on direction II—II of FIG. 1.

In particular, as shown in FIG. 2, the distance separating each outer blade of the external face from the cylindrical wall 16*a* of the outer drum is larger than the width (in the radial direction) of the inner blades 22*a*.

FIG. 2 shows that the width of the inner blades 22*a* and the outer blades 22*b* in the radial direction are substantially identical. Further, the inner blades 22*a* are shorter than the outer blades 22*b* if their length is considered to be distributed helically along the external face of the cylindrical wall 16*a* of the outer drum from one end to the center of the cylindrical wall 16*a*.

The direction of rotation of the drum assembly 16 is such that the inner blades 22*a* direct the powder contained in the annular space 24 towards the end plates 14*b*, i.e. towards the ends of the shell 14.

Again during rotation of the drum assembly 16, the outer blades 22*b* transport the powder contained in the annular space 24 towards the diametrical symmetrical plane of the shell 14 passing through the axes (Y, Y') and (Z, Z'), i.e. towards the center of the shell 14. This action has the advantage of making it possible during discharging to discharge all of the powder contained in the annular space 24.

In order to limit retention of the powder in this annular space 24, a scraping device is disposed between each end plate 14*b* of the cylindrical shell 14 and the corresponding disk-shaped wall 16*b* to prevent powder from being deposited in said zone. This scraping device is mobile and is advantageously constituted by at least one radial blade 26 mounted integrally on the outer face on each of the two disk-shaped walls 16*b*.

The cylindrical shell 14 also comprises a plurality of openings: a filling opening 14*c*, a discharge opening 14*d*, a degassing opening 14*i*, an inlet orifice 14*e* for cooling air, an outlet orifice 14*f* for cooling air and orifices 14*g* and 14*h* for the shaft to pass.

In particular, during discharging, said degassing orifice 14*i* is opened to allow the homogenizing apparatus 10 to "breathe".

At each bearing 20, the space between the annular space 24 and the inside of the glovebox 12 is sealed using a sealing system that comprises at least one stuffing box and preferably pads, in contact with the shaft 18 of the drum assembly 16. Each bearing 20 allows the shaft 18 and the drum which is integral therewith to rotate via rolling means, preferably a roller bearing.

The powder is supplied from the upstream apparatus to the powder homogenizing apparatus 10 via a supply chute 28 disposed between the opening 12*a* of the glovebox and the filler orifice 14*c*.

As can be seen in FIGS. 1 to 3, the filler orifice 14*c* is connected to the powder supply chute 28 which communicates with an upstream apparatus.

A first shut-off valve 30 disposed in the supply chute 28 close to the filler orifice 14*c* opens or closes the passage for powder passing from the upstream apparatus towards the homogenizing apparatus 10.

To evacuate the powder towards the downstream apparatus, an outlet chute 32 is provided from the discharge orifice 14*d* down to at least the opening 12*b* of the glovebox.

The discharge orifice 14*d* is connected to the powder outlet chute 32, which is provided with at least one valve-forming system to be able to close or open the passage for powder passing from the homogenizing apparatus 10 to downstream apparatus communicating with the powder outlet chute 32.

In the embodiment shown (see FIGS. 1 and 2), three valve-forming systems are provided to control and regulate the outlet for powder leaving the homogenizing apparatus 10.

The valve-forming system comprises firstly a shutter trap 34 controlled by actuators 36. The homogenizing apparatus also comprises, downstream of the shutter trap 34, a second shut-off valve in the powder outlet chute 32. Said second shut-off valve 38 can separate the homogenizing apparatus 10 from the downstream apparatus; meanwhile, under the control of actuators 36, opening the trap 34 can limit the rate at which the homogenizing apparatus 10 empties.

In the closed position of the trap, the shutters of the trap 34 are in an extension of the lower wall of the barrel 14*a* which defines the annular space 24, thus avoiding the formation of a recess in which powder might become lodged.

Further, the homogenizing apparatus 10 comprises a guillotine valve 40 (see FIG. 2) between the shutter trap 34 and the second shut-off valve 38, which can modify the flow rate of the powder flowing via the outlet chute 32 towards the downstream apparatus.

The two cooling systems (internal and external) are described below in connection with FIGS. 1 to 3.

The internal cooling system comprises a system for supplying cold air, provided with an inlet tube for cold air 42 mounted on a revolving joint 44. The revolving joint 44 is itself disposed outside the cylindrical shell 14 around a first end portion 18*a* of the shaft 18 so that said inlet tube 42 communicates with a first longitudinal channel 18*c* extending longitudinally in the entire first end portion 18*a* of the shaft 18 from outside the shell 14 to the space 16*e*, 16*f* defined between the outer drum and the inner drum.

To this end, the revolving joint 44 has an internal annular space 44*a* (see FIG. 3) in fluid communication firstly with the inlet tube 42 and secondly, via at least one supply orifice 18*e*, with said first channel 18*c*. The embodiment illustrated comprises two inlet orifices 18*e*.

Figure 1A:
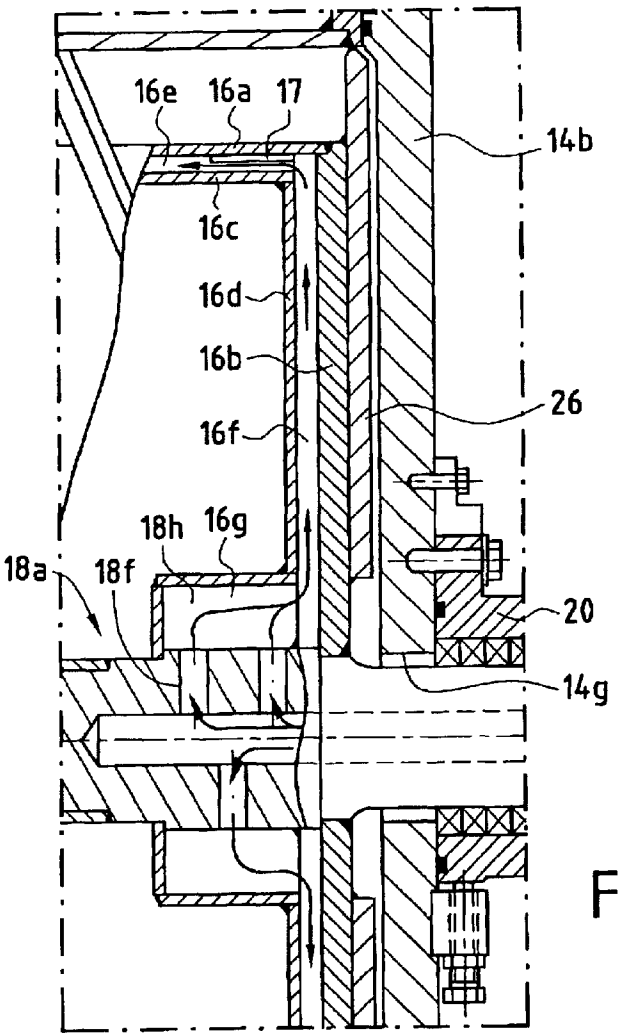
FIGS. 1A and 1B are fragmentary enlarged views of details IA and IB respectively of FIG. 1.
Figure 1B:
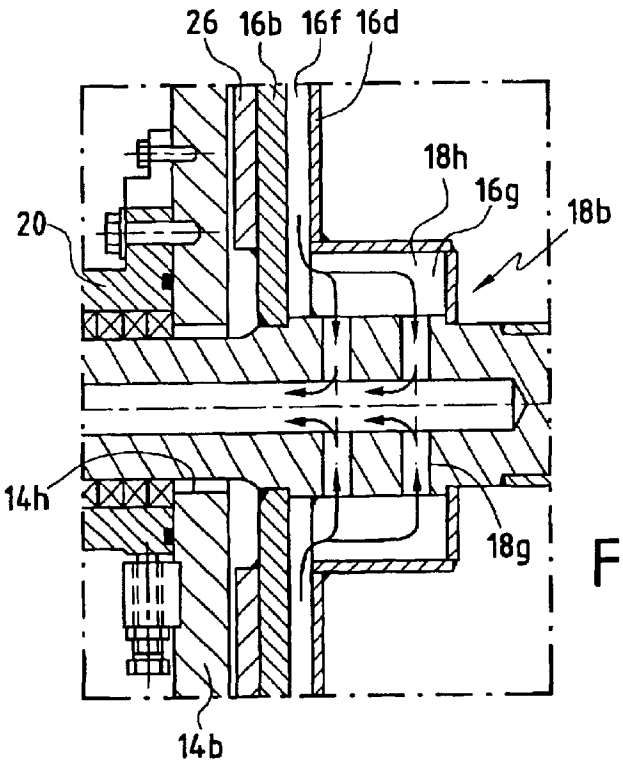

In order to let cold air from the inlet tube 42 into the space 16*e*, 16*f* defined between the outer drum and the inner drum, the first end portion 18*a* of the shaft is provided with at least one supply orifice 18*f* at its portion located in an enlarged zone 16*g* of the radial zone 16*f*. Three supply orifices 18*f* are shown in FIG. 1A and in the right hand portion of FIGS. 1 and 3.

At the other end of the homogenizing apparatus 10, in a symmetrical manner, shaft 18 comprises a second end portion 18*b* that is also hollow at the location of a second longitudinal channel 18*d*. The first longitudinal channel 18*c* and the second longitudinal channel 18*d* do not communicate with each other in shaft 18.

After circulating inside the space 16*e*, 16*f* defined between the outer drum and the inner drum, air is exhausted via the second channel 18*d* by means of at least one exhaust orifice 18*g* located in the second end portion 18*b* of shaft 18. Four exhaust orifices 18*g* can be seen in FIG. 1B and in the left hand portion of FIGS. 1 and 3. Said orifices 18*g* are in fluid communication with the second channel 18*d* and with the interior of the space 16*e*, 16*f* defined between the outer drum and the inner drum, in the enlarged zone 16*g* of the radial zone 16*f*.

The second channel 18*d* extends at least up to the opening 12*d* of the glovebox so that air is exhausted and optionally recycled to a low pressure ventilation system.

To finish cooling the homogenizing apparatus 10 and the powder disposed in the annular space 24, an external cooling system is provided formed in the lower portion of the homogenizing apparatus 10, i.e., where most of the powder is to be found under the effect of gravity.

To this end, and as can be seen in FIG. 2, at least in the lower half of the cross section of the shell 14, the barrel 14*a* is surrounded by a lower wall 46*a* defining a double-walled jacket 46.

Said jacket 46 is connected to a further cold air supply system, firstly via an inlet line 46*b* located at a first end of the jacket 46 which is located on the side of the second end portion 18*b* of the shaft, and via an outlet line 46*c* disposed at the second end of the jacket which is located on the side of the first end portion 18*a* of the shaft.

Thus, it can be seen that the upper portion of the barrel 14*a* is constituted by a single walled shell while the lower portion of the barrel 14*a* is constituted by the double walled jacket 46. The space defined by the external face of the wall of the barrel 14*a* and by the internal face of the lower wall 46*a* of the double jacket 46 is provided with fins 48 to encourage heat exchange (see FIGS. 2 and 3). Preferably, for better heat exchange with the annular space filled with powder, the fins 48 are located against the wall 14*a* of the jacket. In the embodiment shown, the fins 48 extend parallel to the axis (X, X') of rotation of the drum assembly 16.

The inlet and outlet lines 46*b* and 46*c* are connected to a cooling system 50 which is outside the glovebox 12 (see FIG. 3). This air cooling system 50 comprises a ventilator 52 and a fin-tube heat exchanger 54 cooled by circulating ice water 56. This system 50 can cool air leaving via outlet line 46*c* from a temperature of about 50° C. to a temperature of the order of 25° C., the air being sent via ventilator 52 to the inlet channel 46*b*.

In order to encourage heat exchange between the internal cooling system and the annular space 24 filled with powder, it is advantageous to ensure that the space 16*e*, 16*f* defined between the outer drum and the inner drum is provided with fins 17 as can be seen in particular in FIGS. 2 and 3. In the embodiment shown, said fins 17 are located on the inner face of the cylindrical wall 16*a* and parallel to the axis (X, X') of the inner and outer drums.

As can be seen in FIG. 1, the upper portion of the shell 14 includes the degassing orifice 14*i* connected to a tube leading to a solenoid valve provided with a filter that allows the homogenizing apparatus 10 to "breathe" during the discharge phase. In this case, air is admitted from the chamber formed in the glovebox 12.

The homogenizing apparatus 10 of the present invention preferably also comprises a vibratory system disposed outside the cylindrical shell 14 close to the discharge orifice 14*d*. As shown in FIGS. 1 and 2, a set of four hammers 58 is located against jacket 46 on the outer face of the lower wall 46*a*, equidistantly disposed around the outlet chute 32. These pneumatic hammers send vibrations to the jacket 46: said vibrations detach powder from the walls of the barrel 14*a* and encourage discharge of the homogenizing apparatus 10. It should be understood that this vibratory system could also be disposed directly in contact with the barrel 14*a*.

Further, the geometry of the annular space 24 is designed to provide criticality safety for the apparatus during homogenization of a certain charge of plutonium (di)oxide powder $PuO_2$.

In operation, the plutonium oxide from the upstream cycle is received under gravity into the homogenizing apparatus into the annular space 24 defined above.

During filling, with the drum assembly 16 rotating, the first shut-off valve 30 located in the supply chute 28 is open, and the trap 34 and the second shut-off valve 38 located in the outlet chute 32 are closed.

The first shut-off valve 30 is then closed and the degassing orifice 14*i* is opened to allow the homogenizing apparatus 10 to "breathe" during the homogenization phase.

The powder (plutonium oxide) occupying the annular space 24 is homogenized by rotating the drum assembly 16, at a slow speed during filling and optionally at a higher speed once the desired quantity of powder has been introduced into this annular space.

It should be understood that the homogenizing apparatus comprises two air cooling systems:

an internal cooling system located inside the drum assembly 16 per se (space 16*e*, 16*f*) and surrounded by the annular space 24. This cooling system is constituted by a stream of air passing partially inside the shaft 18 and the space of revolution 16*e*, 16*f* defined between the outer drum and the inner drum to evacuate heat released by rotation of the drum assembly, by the sealing system (pads and stuffing box) and by the calorific value of the powder, this air being taken up by the ventilation system;

an external cooling system that surrounds the lower portion of the annular space 24: this is the cooling circuit of the double walled jacket 46 which can evacuate heat released from the plutonium oxide and agitation thereof.

Proper operation of the internal and external cooling systems can be assured by measuring the temperatures upstream and downstream of the homogenizing apparatus 10 of the present invention.

It can be seen that the two cooling systems firstly ensure evacuation of the heat energy released by mechanical friction in the homogenizing apparatus and secondly, ensure evacuation of the heat energy released by the plutonium oxide.

During the phase for discharging the homogenizing apparatus, the first shut-off valve 30 of the supply chute 28 is kept closed, the shutter trap 34 is opened and the second shut-off valve 38 of the outlet chute 32 is opened while the guillotine valve 40 regulates the discharge rate of the powder. To facilitate discharge and evacuation of the powder from the annular space 24 to the downstream apparatus, the solenoid valve and its associated filter can admit air into shell 14 from the chamber formed by the glovebox 12.

The degree of opening of the shutter trap 34, the rate of rotation of the drum assembly 16 and the rate of rotation of the guillotine valve 40 allow the instantaneous flow rate of the powder towards the downstream apparatus to be adjusted.

What is claimed is:

1. Powder homogenizing apparatus, comprising:

a cylindrical shell of circular section and of substantially horizontal axis, which shell is sealed and with a cylindrical barrel, said cylindrical barrel having a first end and a second end closed by a disk-shaped end plate, said shell being provided with at least one filler orifice located in the upper portion of said shell and at least one discharge orifice opening into the bottom of said shell;

an assembly of cylindrical drums of circular section located inside the shell with which it is coaxial and fluidtight, said drum assembly comprising an inner drum and an outer drum each provided with a cylindrical wall, said cylindrical wall having a first end and a second end closed by a disk-shaped wall, the external face of the cylindrical wall of said outer drum being overlaid with blades that can homogenize the powder contained in the annular space formed between the cylindrical wall of the outer drum and the barrel of the shell, a space of revolution being formed between said inner and outer drums;

a shaft disposed along said longitudinal axis through said cylindrical shell, mounted on a bearing at each end plate and on which said assembly of cylindrical drums is mounted in integral manner, said shaft comprising a first end portion provided with a first internal longitudinal channel and a second end portion provided with a second internal longitudinal channel, said first channel being connected, outside the shell, to a system for supplying cold air and said first end portion being provided inside said shell with at least one supply orifice for providing cold air to said space of revolution from said first channel, said second end portion being provided, inside said shell, with at least one exhaust orifice placing said space of revolution in fluid communication with said second channel, and said second channel being connected, outside said shell, to an air exhaust system to release air from said space of revolution, a sealing system being provided for each bearing; and drive means for rotating said shaft.

2. Apparatus according to claim 1, wherein a scraper device is disposed between each end plate of the cylindrical shell and the disk-shaped wall of the corresponding drum to prevent powder from being deposited.

3. Apparatus according to claim 1, wherein said sealing system comprises at least one stuffing box.

4. Apparatus according to claim 1, wherein said system for supplying cold air comprises an inlet tube for cold air mounted on a revolving joint disposed, outside the shell, around said first end portion of the shaft so that said inlet tube communicates with said first channel.

5. Apparatus according to claim 4, wherein said revolving joint comprises an internal annular space in fluid communication with said inlet tube and with said first channel at the level of at least one inlet orifice.

6. Apparatus according to claim 1, wherein said first end portion is provided with at least one supply orifice and wherein said second end portion is provided with at least one exhaust orifice.

7. Apparatus according to claim 1, wherein the space defined between the outer drum and the inner drum is provided with fins.

8. Apparatus according to claim 1, wherein said barrel is formed, at least in its lower portion, by a sealed jacket with a double wall in which cold air from a further cold air supply system can circulate.

9. Apparatus according to claim 8, wherein said jacket is provided with fins located on the face of the upper wall of said jacket facing the inside of said jacket.

10. Apparatus according to claim 8, wherein said jacket is connected to said other cold air supply system via an inlet line located at the end of the jacket adjacent to the second end portion of the shaft, and via an outlet line located at the end of the jacket adjacent to the first end portion of the shaft.

11. Apparatus according to claim 1, wherein said filler orifice is connected to a powder supply chute which is provided with a first shut-off valve, said supply chute communicating with an upstream apparatus.

12. Apparatus according to claim 1, wherein the upper portion of said shell is provided with at least one degassing orifice connected to a solenoid valve provided with a filter.

13. Apparatus according to claim 1, wherein said discharge orifice is connected to a powder outlet chute which is provided with at least one valve-forming system, said powder outlet chute communicating with a downstream apparatus.

14. Apparatus according to claim 13, wherein said valve-forming system comprises a shutter trap controlled by actuators.

15. Apparatus according to claim 14, further comprising a second shut-off valve downstream of said shutter trap.

16. Apparatus according to claim 15, further comprising, between said shutter trap and said second shut-off valve, a guillotine valve that can modify the flow rate of the powder flowing via the powder outlet chute towards the downstream apparatus.

17. Apparatus according to claim 1, further comprising a vibratory system disposed outside said cylindrical shell close to said discharge orifice.

18. Apparatus according to claim 1, wherein said blades are helical and form a screw thread with a pitch that is reversed with respect to the pitch on the other axial half of the outer drum.

19. Apparatus according to claim 18, wherein the cylindrical wall of each axial half of the external drum is overlaid on its outer surface with an inner helical blade attached to said outer surface all the way along said axial half and an outer helical blade spaced from said outer face along the entire length of said axial half, said inner and outer blades having a screw pitch that is reversed with respect to the pitch on the other axial half of the cylindrical wall.

20. A method of homogenizing and cooling a powder, using the powder homogenizing apparatus defined in claim 1, wherein said apparatus is placed in a glovebox and wherein said powder is radioactive.

21. A method of homogenizing and cooling a powder, using the powder homogenizing apparatus defined in claim 1, the method comprising the following steps:

a) closing the discharge orifice;

b) activating said drive means to cause said shaft and said drum assembly to rotate;

c) activating said system for supplying cold air to fill and circulate cold air in the space defined between the outer drum and the inner drum;

d) opening said filler orifice to allow powder to enter into said annular space between the outer drum and the barrel of the shell;

e) closing said filler orifice when the desired quantity of powder has been introduced into said annular space;

f) carrying out homogenization by rotating said shaft and said drum assembly; and g) opening said discharge orifice to empty said annular space when homogenization is complete.

* * * * *